United States Patent [19]

Sansevero et al.

[11] Patent Number: 4,984,671

[45] Date of Patent: Jan. 15, 1991

[54] BALUSTRADE RADIUS DEVELOPMENT FOR CURVED ESCALATOR

[75] Inventors: Frank Sansevero, West Hartford; Dat Nguyen, New Britain, both of Conn.

[73] Assignee: Otis Elevator Company, Farmington, Conn.

[21] Appl. No.: 550,927

[22] Filed: Jul. 11, 1990

[51] Int. Cl.[5] ..... B66B 21/06

[52] U.S. Cl. ..... 198/328; 198/335

[58] Field of Search ..... 198/328, 331, 335, 336, 198/337, 321, 326, 327, 332

[56] References Cited

U.S. PATENT DOCUMENTS

| | | | |
|---|---|---|---|
| 1,049,613 | 1/1913 | Seeberger | 198/337 X |
| 2,211,427 | 8/1940 | Margles | 198/336 X |
| 3,049,213 | 8/1962 | Fabuca | 198/336 |
| 3,749,224 | 7/1973 | Engeler | 198/331 |
| 4,154,336 | 5/1979 | Sorokin | 198/326 X |
| 4,227,605 | 10/1980 | Höfling | 198/331 |

*Primary Examiner*—D. Glenn Dayoan

*Attorney, Agent, or Firm*—William W. Jones

[57] ABSTRACT

The balustrade of a linear or curved escalator has upper and lower edges that are curved in elevation between the horizontal landing portions and the constant slope inclined medial portion of the escalator. The radius which defines the upper and lower balustrade curves is developed so as to have the maximum value possible without producing a discontinuity in the vertical distance between the escalator handrail and the escalator tread surface which would be noticeable by a passenger on the escalator.

6 Claims, 2 Drawing Sheets

BALUSTRADE RADIUS DEVELOPMENT FOR CURVED ESCALATOR

TECHNICAL FIELD

This invention relates to escalator balustrades, and more particularly to the determination of the most desirable balustrade transitional zone radius in elevation for a linear or curved escalator.

BACKGROUND ART

An escalator typically has five different zones when viewed in elevation. These are: the entrance zone, which is horizontal; the entrance transition zone, which has a gradually increasing slope angle; the medial inclined zone, which has a fixed slope angle; the exit transition zone, which has a gradually decreasing slope angle; and the exit zone, which is horizontal. The step path is thus arcuate in the transition zones, and linear in the horizontal and inclined zones, in elevation. Likewise, the upper and lower margins or edges of the balustrade have linear and arcuate components. A curved escalator has a slightly more complicated geometry due to its curvature in plan, however, the elevational projections of the curved escalator are generally the same as the linear escalator. Generally, the handrail of the escalator will move along a guide rail which is mounted on the upper edge of the balustrade. Thus, the handrail will have a path of travel, in elevation, that follows the elevational projection of the upper edge of the balustrade.

When determining the radii and angles of incline of the path of travel of the escalator steps, a convenient reference point in elevation is the nose of the steps. The "nose" of the step is the line where the step tread and riser meet on the step, which is, in elevation, a point. These serial points thus provide a good reference for the serial steps which can be placed on the desired line along which the steps should move from entrance to exit. It is highly desirable that an escalator passenger not be able to detect any apparent vertical changes in the position of the handrail relative to him or herself during the ride from entrance to exit. This means that there should not be a perceptible rise or fall of the handrail sensed by the passenger during the ride. The apparent solution to the problem would seem to be to have the upper edge of the balustrade track the path followed by the nose of the steps, however, when this approach is followed, the handrail will perceptively rise when the medial inclined portion of the escalator is reached since the plane of the treads on which the passengers stand lies below the line connecting serial step nose points in the incline. Thus, the upper edge of the balustrade should not track the line which determines the path of travel of the steps or step chains.

DISCLOSURE OF THE INVENTION

This invention relates to the determination of the most desirable radius of curvature in elevation of the entrance and exit transition zone paths of travel of the upper edge of the escalator balustrade, and thus the handrail, which is the largest radius of curvature which can be used without resulting in a perceptible change in the elevation of the handrail with respect to the steps at the transition zones of the escalator. The reason that the largest possible radius is the most desirable radius is that a most aesthetically pleasing line is thereby produced, and friction resulting from the handrail moving over the guide rail is minimized. This invention applies equally to linear and curved or helical escalators. The invention uses three selected parameters of the escalator in question to calculate the maximum transition radius for the lower and upper transition zones. The selected parameters are: the height of the escalator from landing to landing; the upper and lower step chain transition radii (as determined by the serial positions of the step nose); and the slope angle in elevation. These three parameters are the determinative variables in the escalator which may change from installation to installation.

It is therefore an object of this invention to provide an escalator having a balustrade transition zone radius of curvature in elevation which produces an aesthetically desirable form and minimum handrail friction in the transition zones.

It is a further object of this invention to provide an escalator of the character described which is curved in plan and wherein the balustrade radius is the largest possible radius operable to interconnect the escalator landing zone with the medial inclined zone without producing a perceptible change in the vertical distance between the step tread and handrail.

These and other objects and advantages will be readily appreciated from the following detailed description of a preferred embodiment of the invention when taken in conjunction with the accompanying drawings, in which:

BEST MODE FOR CARRYING OUT THE INVENTION

Figure 1:
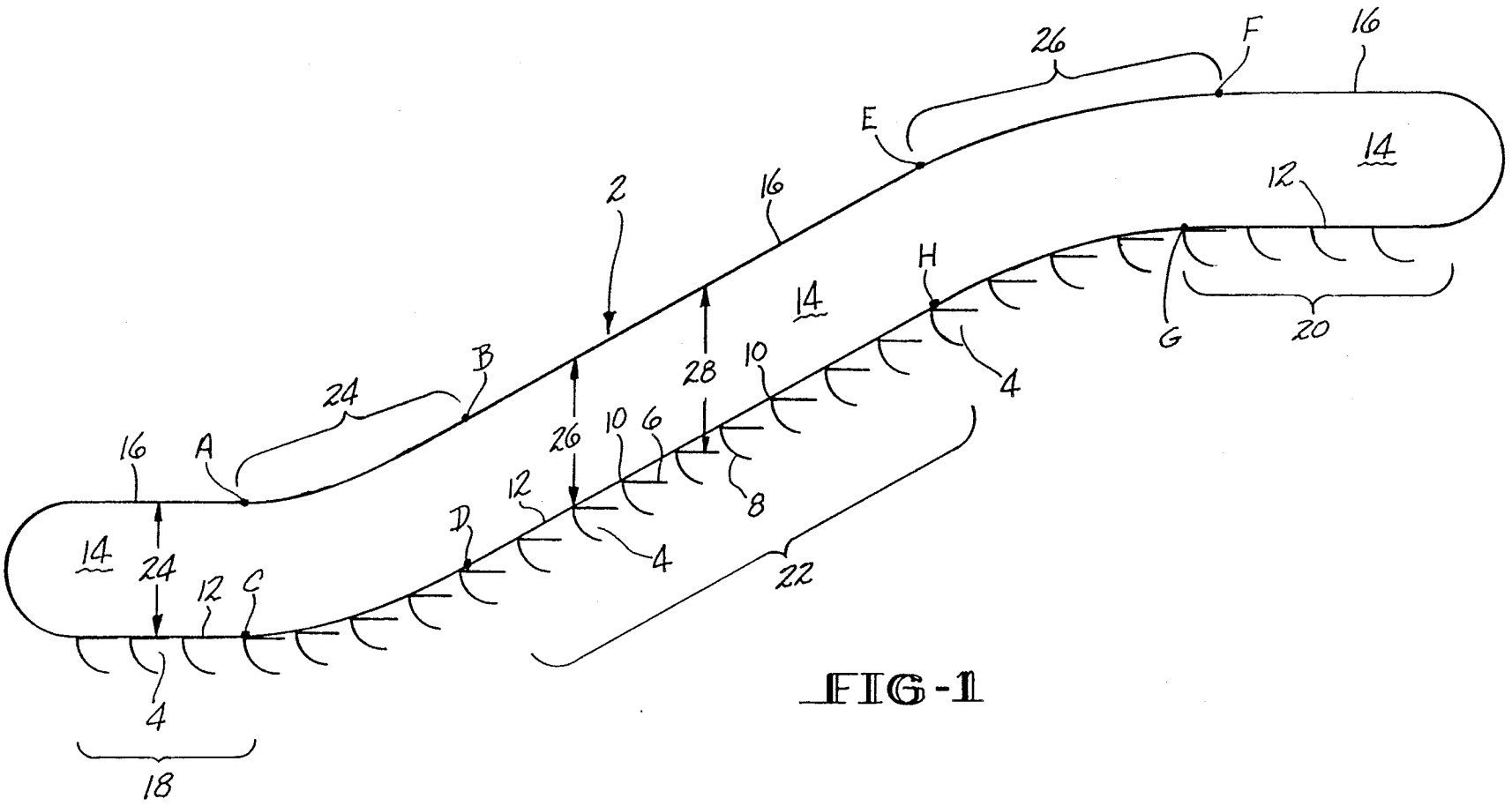
FIG. 1 is a side elevational schematic view of an escalator employing a balustrade radius which is developed in accordance with this invention.
Figure 2:
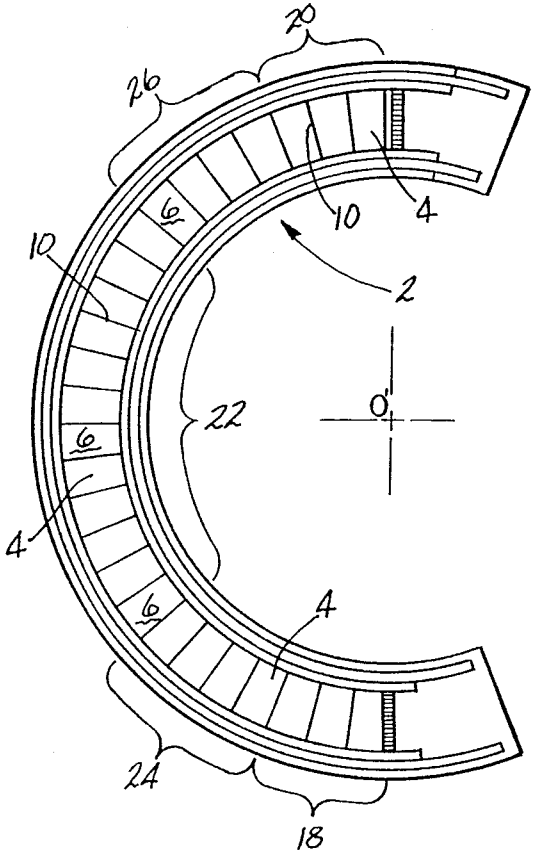
FIG. 2 is a plan view of a curved escalator which may employ the balustrade radius of this invention.

Referring now to FIGS. 1 and 2, there is shown in FIG. 1 an elevational view of an escalator which is depicted somewhat schematically. The view is a conventional side elevational view of a linear escalator, or a planar projected side elevational view of a curved escalator of the type shown in plan in FIG. 2. The escalator 2 includes a series of steps 4 which are interconnected by a step chain (not shown). Each step 4 includes a tread part 6 on which a passenger stands, and a riser part 8. The point 10 (or line 10 when viewed in plan) of intersection between the tread 6 and riser 8 on each step 4 is termed the nose of the step. The path of travel of the steps 4 can thus be defined by a line 12 which interconnects each step nose 10. The escalator 2 also has balustrades 14 with an upper edge 16 which essentially defines the path of travel of the escalator handrail, which is mounted on top of the escalator balustrade 14. The escalator 2 whether linear or curved, will have lower and upper landing zones 18 and 20 which are horizontal, a medial inclined zone 22 having a constant slope angle, and lower and upper transition zones 24 and 26 which have constantly varying slope angles. It will be noted from FIG. 1 that, in elevation, the lines 12 and 16 are straight in the landing zones 18 and 20, and in the inclined zone 22, and are radiused in the transition zones 24 and 26. This holds true whether the escalator is linear or curved, but it will be appreciated that each of the zones of the curved escalator, i.e., the landing zones 18, 20, the transition zones 24, 26 and the inclined zone 16 will be longer due to the plan curve of the curved escalator.

As previously noted, the paths of the lines 12 and 16 are determined by radii in elevation in the transition zones 24 and 26 of the escalator. When practicing this invention, the transition zone for the upper edge of the balustrade 14, and therefore, for the handrail is longer than the transition zone for the step noses 10. Specifically, the lower handrail transition zone begins at point A and ends at point B, as shown in FIG. 1. Meanwhile, the lower transition zone for the step noses begins at point C and ends at point D. Likewise, the upper handrail transition zone begins at point E and ends at point F, while the upper step nose transition zone begins at point G and ends at point H. It will be noted from FIG. 1, that points A and C, and E and H are in common vertical planes, thus the transition zones for both the handrail and step noses begin in common vertical planes. In contrast, the end points D and B and G and F are not in common vertical planes. Thus the handrail enters its inclined zone after the step noses have entered their inclined zone, and the handrail enters its upper horizontal landing zone after the step noses have entered their upper horizontal landing zone. The reason for customizing the transition zone of each component is to keep the vertical distance between the handrail and step treads 6 as constant as possible throughout each transition zone so that passengers will not experience a perceptible rise or fall of the handrail therein. It will be noted from FIG. 1 that the vertical distance 24 between the step noses 10 and the upper edge 16 of the balustrade 14 in the landing zones is larger than the vertical distance 26 between the step noses 10 and the upper edge 16 of the balustrade 14 in the inclined zone. Likewise, the vertical distance 28 between the portion of the step tread 6 where a passenger stands is greater in the inclined zone than the vertical distance 26. Thus, the vertical distances 24 and 28 are kept approximately equal throughout the path of travel of the escalator by lengthening the upper and lower transition zones of the handrail. This transition zone lengthening also lowers the frictional forces generated between the handrail and guide rail in the transition zones.

Figure 3:
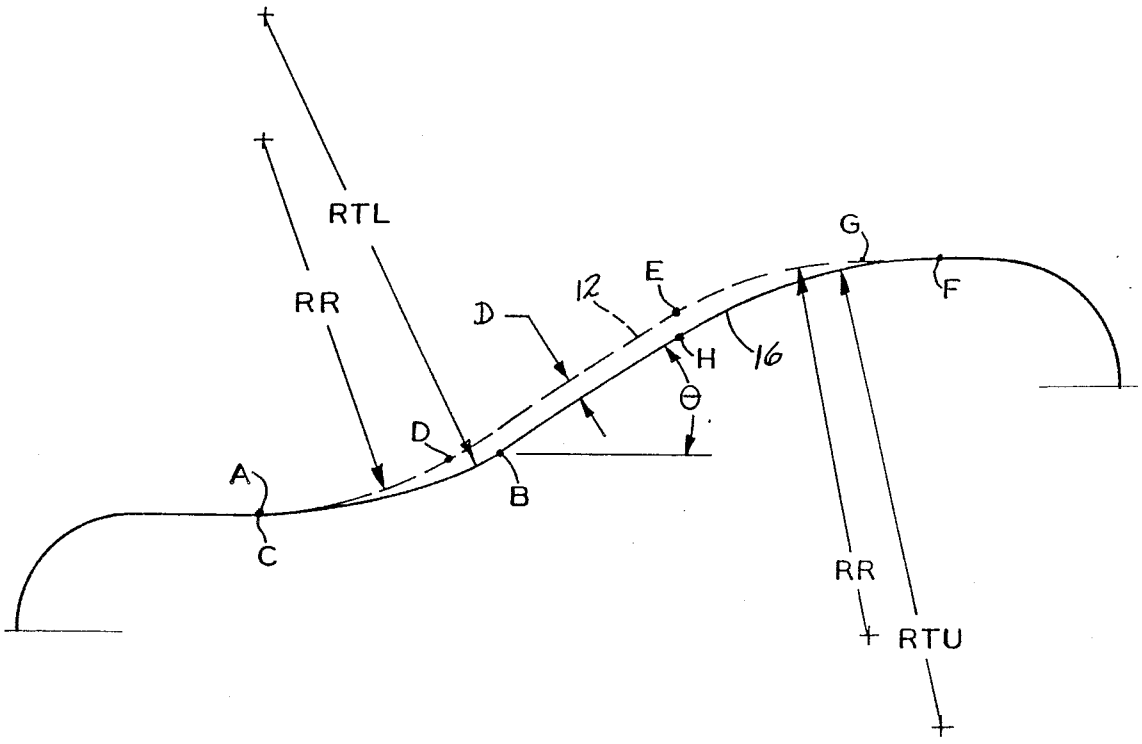
FIG. 3 is an elevational view wherein the step nose path of travel and the upper balustrade edge profile are superimposed for clarity of comparison.

Referring to FIG. 3 of the step nose path of travel 12 (shown in broken lines) and the upper balustrade edge or handrail path of travel 16 are shown superimposed on each other to highlight the relationship between the two. In FIG. 3, $\Theta$ is the slope angle of the paths of travel in the inclined zone; RR is the step nose line transition radius in elevation; D is the distance between the two lines of travel in the inclined zone; RTL is the handrail lower transition radius in elevation; and RTU is the handrail upper transition radius in elevation. RR, $\Theta$ and D are known values which are preselected based on the height and distance parameters of the escalator in question. RTL and RTU are unknowns which are calculated by solving the equations:

$$RTL = \frac{D}{(1 - \cos\theta)} + RR;$$

and $$RTU = \frac{D}{(1 - \cos\theta)(\cos\theta)} + RR.$$

The RTL and RTU resultant values will produce handrail transition radii which will meet the objectives of this invention.

It will be readily appreciated that the transition path of travel of the handrail formed in accordance with this invention produces a most desirable aesthetic appearance, particularly in a curved escalator, results in minimal relative vertical movement of the handrail perceptible to a passenger between landing and inclined zones, and produces minimal frictional forces between the handrail and the handrail guide rail in the transition zones of the escalator.

Since many changes and variations of the disclosed embodiment of the invention may be made without departing from the inventive concept, it is not intended to limit the invention otherwise than as required by the appended claims.

What is claimed is:

1. An escalator of the type having entry and exit zones, a medial inclined zone and upper and lower transition zones connecting said entry and exit zones to said inclined zone respectively, said entry, exit and inclined zones being rectilinear in elevation and said transition zones being curvilinear in elevation, said escalator comprising:

a. a series of steps having risers and treads meeting at step noses which are defined by a point in elevation, said steps traveling through said escalator zones along a first path of travel defined in elevation by a line connecting adjacent step nose points, said first path line being defined in elevation in said transition zones by a first radius; and b. a pair of balustrades flanking said steps, said balustrades having upper edges defining a second path of travel along which handrails mounted on said balustrades move, said second path of travel being defined by a second path line in elevation, said second path line being defined in elevation in said transition zones by a second radius which is larger than said first radius and operable to maintain a substantially constant vertical distance between a central portion of the step treads and the handrail throughout the passenger-bearing path of travel of the escalator.

2. The escalator of claim 1 wherein said upper and lower transition zone paths of travel of said handrail and of said step noses each have a first end disposed in common vertical planes.

3. The escalator of claim 2 wherein said upper and lower transition zone paths of travel of said handrail and of said step noses each have opposite ends which terminate in respective spaced apart pairs of vertical planes.

4. The escalator of claim 3 wherein said handrail transition zone paths of travel are defined by radii which are determined by solving the equations:

$$RTL = \frac{D}{(1 - \cos\theta)} + RR;$$

and $$RTU = \frac{D}{(1 - \cos\theta)(\cos\theta)} + RR;$$

wherein:

D is the distance between the superimposed paths of travel of the handrail and step noses in the inclined zone;

Θ is the slope angle in the inclined zone;

RR is the step nose path of travel radius in the transition zones;

RTL is the handrail lower transition zone path of travel radius; and

RTU is the handrail upper transition zone path of travel radius.

5. The escalator of claim 4 wherein said zones lie along a curved path of travel in plan.

6. An escalator of the type having a curved path of travel in plan, and including entry and exit landing zones, a medial inclined zone, and upper and lower transition zones connecting said inclined zone with said landing zones; said escalator including a series of steps following rectilinear paths of travel in elevation in said landing and inclined zones, and following first curvilinear paths of travel in elevation in said transition zones; and a handrail following rectilinear paths of travel in elevation in said landing and inclined zones, and following second curvilinear paths of travel in elevation in said transition zones, said paths of travel of said steps being defined in elevation by a line connecting step nose points of adjacent steps; and said second curvilinear paths being determined by solving the equations:

$$RTL = \frac{D}{(1 - \text{Cos}\,\theta)} + RR;$$

and $$RTU = \frac{D}{(1 - \text{Cos}\,\theta)\,(\text{Cos}\,\theta)} + RR;$$

wherein:

D is the distance between the superimposed paths of travel of the handrail and step noses in the inclined zone;

Θ is the slope angle in the inclined zone;

RR is the step nose path of travel radius in the transition zones;

RTL is the handrail lower transition zone path of travel radius; and

RTU is the handrail upper transition zone path of travel radius.

* * * * *